US006196489B1

(12) United States Patent
Ma

(10) Patent No.: US 6,196,489 B1
(45) Date of Patent: Mar. 6, 2001

(54) UMBRELLA WIRE-WINDING DEVICE

(76) Inventor: Joen-Shen Ma, F1. 12, No. 578, Kwang Fu S. Rd., Taipei (TW)

( * ) Notice: Subject to any disclaimer, the term of this patent is extended or adjusted under 35 U.S.C. 154(b) by 0 days.

(21) Appl. No.: 09/246,939

(22) Filed: Feb. 9, 1999

(51) Int. Cl.[7] ..... A45B 25/14

(52) U.S. Cl. ..... 242/396.2; 242/395; 242/306; 135/20.3

(58) Field of Search ..... 135/20.3, 15.1; 242/395, 396, 396.1, 396.2, 306

(56) References Cited

U.S. PATENT DOCUMENTS 2,914,154 * 11/1959 Russell .
3,142,307 * 7/1964 Danciart et al. .
3,273,820 * 9/1966 Quenot .
4,386,621 * 6/1983 Redl .
4,619,281 * 10/1986 Redl et al. .
4,622,987 * 11/1986 Redl et al. .
5,437,297 * 8/1995 Crisman et al. .
5,884,859 * 3/1999 Ma .

* cited by examiner

*Primary Examiner*—Robert Canfield
(74) *Attorney, Agent, or Firm*—Rosenberg, Klein & Lee

(57) ABSTRACT

An umbrella wire-winding device includes a casing fixed to a shank of an umbrella. A crank arm is manually operable and has an axle rotatable received in an opening defined in the casing. The axle defines a central bore for drivingly receiving a reel shaft therein. The reel shaft extends through holes defined in the shank for winding a wire extending through the shank to move a runner. The reel shaft has a threaded end and a nut engages with the threaded end of the reel shaft. The nut is axially movably received in a bore defined in the casing whereby the rotation of the reel shaft causes an axial movement of the nut in the bore. The bore has a bottom that limits the axial movement of the nut and thus the rotation of the reel shaft for avoiding over-tensioning the wire. A toothed section is formed on the axle and at least one spring plate is fixed in the casing and engaging with the toothed section thereby serving as a ratchet between the casing and the reel shaft. The contact of the spring plate with the toothed section also generates sound and vibration during the rotation of the reel shaft thereby keeping a user aware of the operation of the wire-winding device.

12 Claims, 5 Drawing Sheets

UMBRELLA WIRE-WINDING DEVICE

FIELD OF THE INVENTION

The present invention generally relates to a large-sized umbrella, and in particular, to a wire-winding device of a large-sized umbrella which winds/unwinds a wire for moving a runner to open/close the umbrella.

BACKGROUND OF THE INVENTION

Large-sized umbrellas, such as beach umbrella, are well known. A conventional large-sized umbrella is shown in FIGS. 1 and 2 of the attached drawings, comprising a shank 10 to which a wire-winding device 11 operable by a crank arm 15 is fixed for winding/unwinding a wire 12 extending through the shank 10. The wires 12 moves a runner 13 along the shank 10 for driving a plurality of rib-stretcher sets 14 to open the umbrella (FIG. 1) or to close the umbrella (FIG. 2).

The conventional wire-winding device, however, has disadvantages. For example, the conventional wire-winding device comprises no means to automatically stop the operation thereof when the umbrella is fully opened. Thus, over-tensioning the wire may occur in the neglect of a user. This may eventually cause a damage or even break of the wire.

Furthermore, the conventional wire-winding device does not comprise means to maintain a half-opened condition of the umbrella. Thus, if the user fails to properly secure the wire at the fully open position, the umbrella automatically close itself due to gravity and may cause damage to the user. A known way to solve the problem is to add a latch to the wire-winding device that prevents the crank arm from being rotated. However, the latch complicates the structure of the umbrella wire-winding device and requires a tedious operation. Manufacture costs of the umbrella are also increased.

It is thus desirable to have an umbrella wire-winding device that overcomes the above problems.

SUMMARY OF THE INVENTION

Accordingly, an object of the present invention is to provide an umbrella wire-winding device comprises means for automatically stopping the rotation of a reel shaft when the umbrella is fully opened thereby avoiding over-tensioning a wire wound on the reel shaft for opening the umbrella.

Another object of the present invention is to provide an umbrella wire-winding device comprising a ratchet mechanism for retaining the umbrella at a half-opened position and preventing the half-opened umbrella from automatically closing itself due to gravity.

A further object of the present invention is to provide an umbrella wire-winding device comprising means for generating vibration and sound during the rotation of the reel shaft which keep the a user aware of the operation thereof.

To achieve the above objects, in accordance with the present invention, there is provided an umbrella wire-winding device comprising a casing fixed to a shank of an umbrella. A crank arm is manually operable and has an axle rotatably received in an opening defined in the casing. The axle defines a central bore for drivingly receiving a reel shaft therein. The reel shaft extends through holes defined in the shank for winding a wire extending through the shank to move a runner. The reel shaft has a threaded end and a nut engages with the threaded end of the reel shaft. The nut is axially movably received in a bore defined in the casing whereby the rotation of the reel shaft causes an axial movement of the nut in the bore. The bore has a bottom that limits the axial movement of the nut and thus the rotation of the reel shaft for avoiding over-tensioning the wire. A toothed section is formed on the axle and at least one spring plate is fixed in the casing and engaging with the toothed section thereby serving as a ratchet between the casing and the reel shaft. The contact of the spring plate with the toothed section also generates sound and vibration during the rotation of the reel shaft thereby keeping a user aware of the operation of the wire-winding device.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 2:
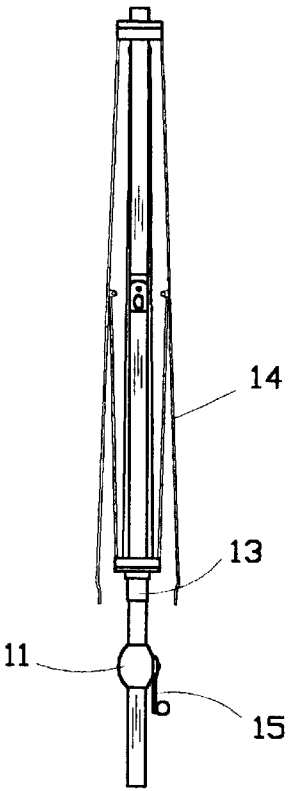
PRIOR ART FIG.2
FIG. 2 is a schematic view of the conventional umbrella at a closed position with the canopy removed.
Figure 1:
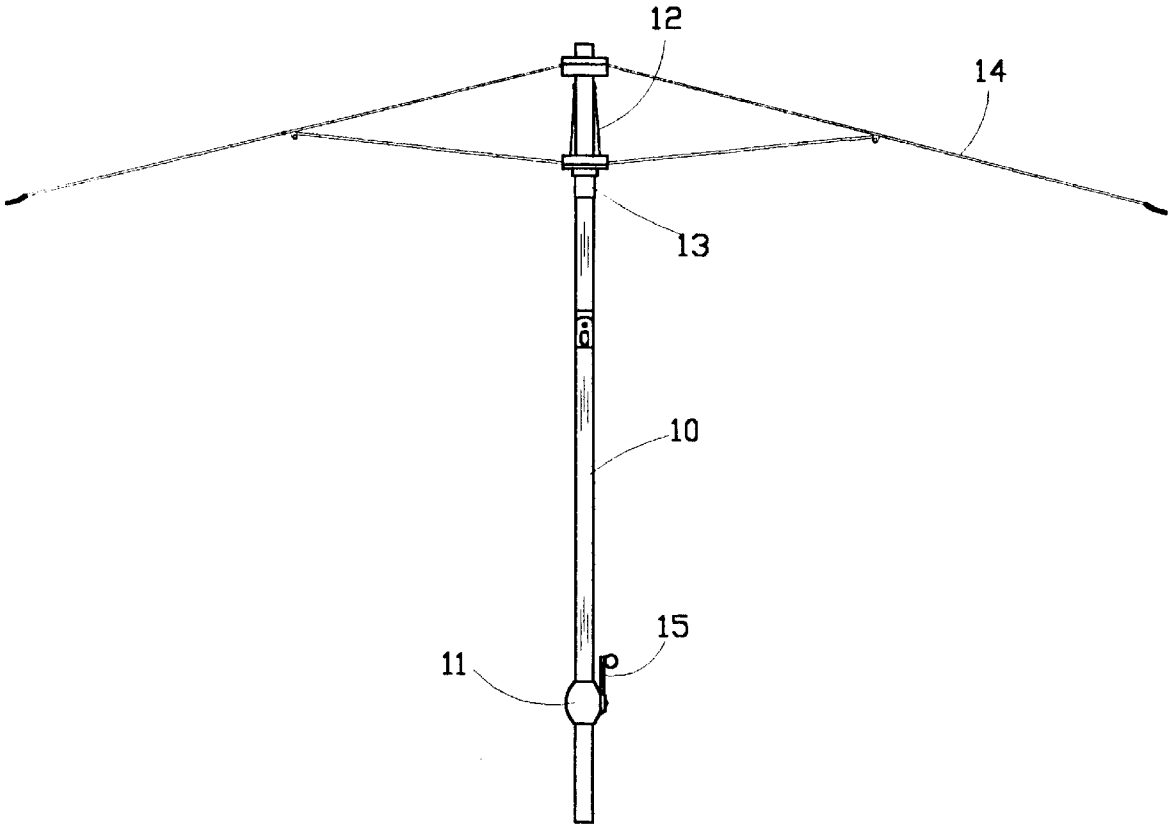
PRIOR ART FIG.1
FIG. 1 is a schematic view showing a conventional umbrella at an open position with a canopy thereof removed.
Figure 3:
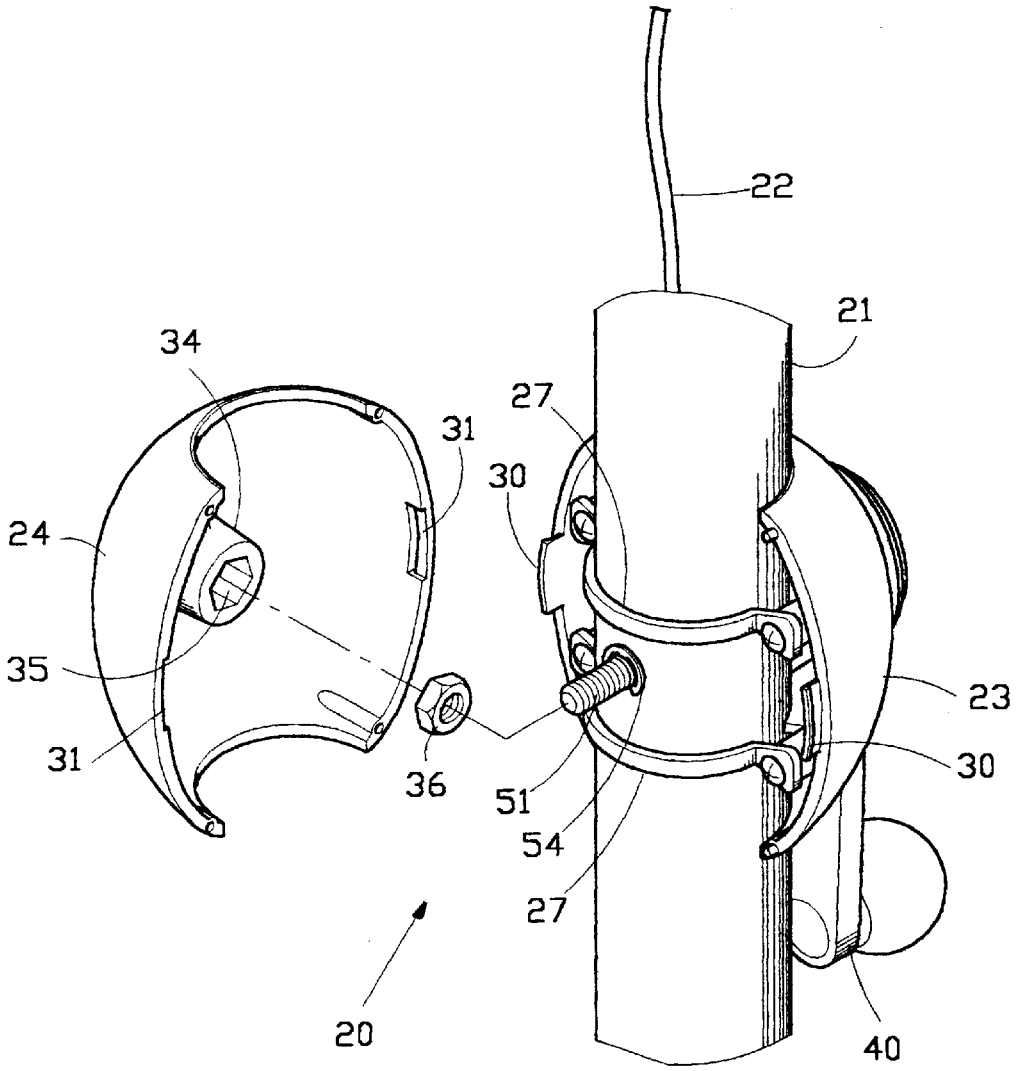
FIG. 3 is an exploded view of an umbrella wire-winding device in accordance with the present invention mounted to a shank of an umbrella.
Figure 4:
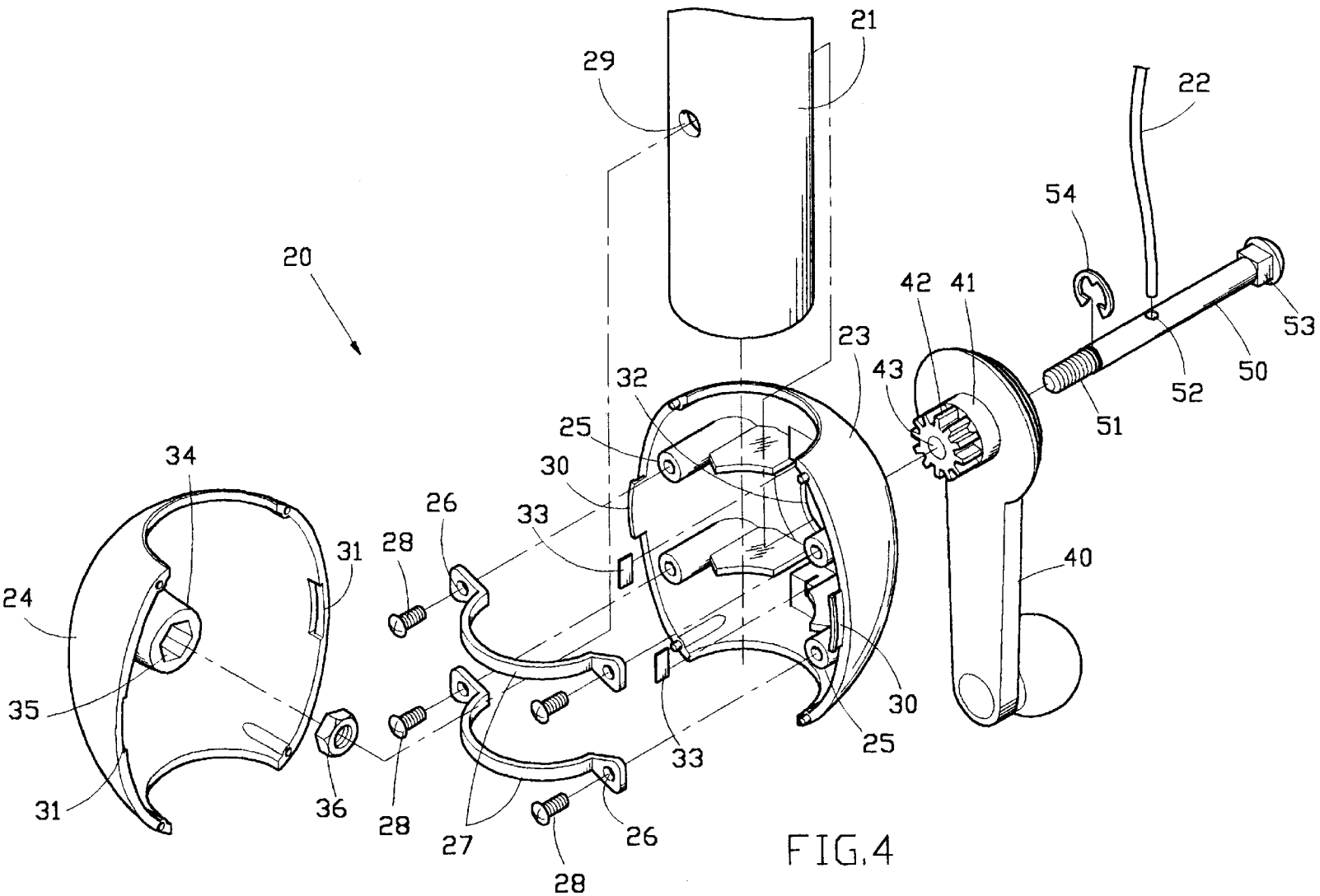
FIG. 4 is a further exploded view of the umbrella wire-winding device of the present invention.

With reference to the drawings and in particular to FIGS. 3 and 4, wherein an umbrella wire-winding device constructed in accordance with the present invention, generally designated by reference numeral 20, is shown, the wire-winding device 20 is adapted to be mounted to a shank 21 of a large-sized umbrella for winding/unwinding a wire 22 extending through an axial central bore (not labeled) thereof for moving a runner (not shown) along the shank 21 to open/close the umbrella.

The wire-winding device 20 comprises a casing having a first and second casing members 23, 24. The casing members 23, 24 are fit over the shank 21 and fixed thereon. The first casing member 23 has pairs of inner-threaded hole 25. A U-shaped clip 27 is fit over the shank 21 and has two ends corresponding to each pair of inner-threaded holes 25 of the first casing member 23. Each end of the U-shaped clip 27 defines a hole 26 through which a bolt 28 extends for engaging with the corresponding inner-threaded hole 25 of the first casing member 23 thereby securing the first casing member 23 to the shank 21.

The first casing member 23 comprises a number of resilient barbs 30 and corresponding thereto, the second casing member 24 defines a number of recesses 31 for engaging with the barbs 30 for retaining the first and second casing members 23, 24 together.

The first casing member 23 defines an opening 32 into which an axle 41 of a crank arm 40 is inserted and rotatably supported thereby. A central bore 43 is defined through the axle 41. The crank arm 40 is manually operable for rotating the axle 41.

Figure 5:
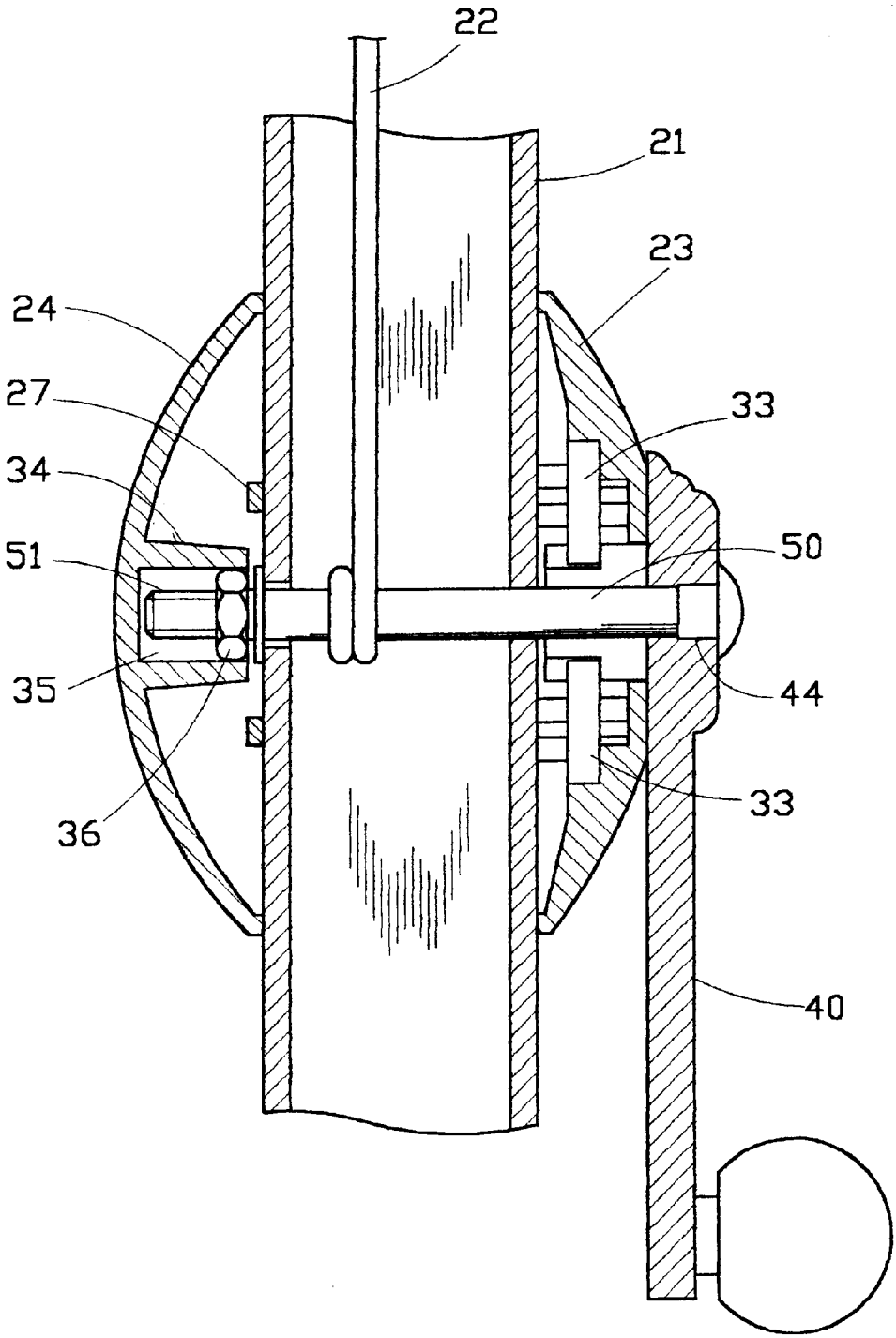
FIG. 5 is a cross-sectional view showing the umbrella wire-winding device at an open position.

A reel shaft 50 extends through the central bore 43 of the axle 41 of the crank arm 40. The reel shaft 50 further extends through holes 29 defined in the shank 21 and is rotatable therein. The reel shaft 50 has a threaded end 51 engaging with a nut 36 received in a bore 35 defined in an inner projection 34 of the second casing member 24. The nut 36 is axially movable in the bore 35 between an open position and a closed position as respectively shown in FIGS. 5 and 6. The bore 35 has a bottom of a predetermined depth which defines the open position and forms a stop for the axial movement of the nut 36 when the umbrella is fully opened.

The wire 22 is tied on the real shaft 50. In the embodiment illustrated, the reel shaft 50 has a hole 52 defined therein for receiving an end of the wire 22 for tying on the reel shaft 50. The rotation of the reel shaft 50 winds the wire 22 around the shaft 50. The depth of the bore 35 is determined by a length of the wire 22 that is wound around the reel shaft in moving the runner from the closed position to the open position.

Figure 6:
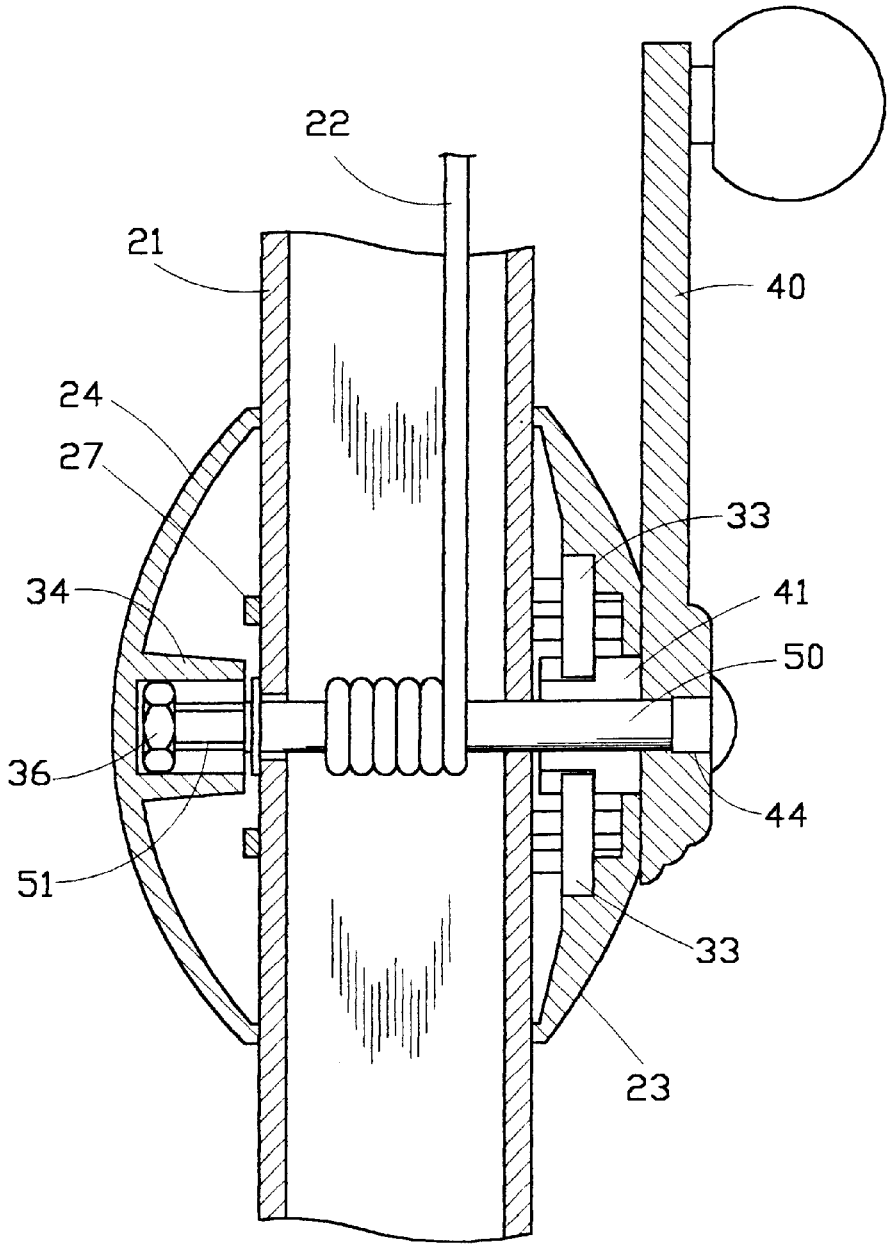
FIG. 6 is a cross-sectional view showing the umbrella wire-winding device at a closed position.

The reel shaft 50 has a polygonal section 53, such as quadrilateral, and corresponding thereto the bore 43 of the crank arm 40 has a polygonal section 44 for drivingly engaging with the polygonal section 53 of the reel shaft 50 whereby the reel shaft 50 is rotatable by the crank arm 40. The rotation of the reel shaft 50 driven by the crank arm 40 winds the wire 22 around the reel shaft 50 as shown in FIG. 6. Meanwhile, the threading engagement between the nut 36 and the threaded section 51 of the reel shaft 50 causes the nut 36 to move axially along the bore 35 from the opening of the bore (the open position, FIG. 5) to the bottom of the bore 35 (the closed position, FIG. 6) which limits a further rotation of the reel shaft 50 and the crank arm 40 and thus preventing the wire 22 from being over-tensioned.

If desired, a C-clip 54 may be mounted to the reel shaft 50 in order to prevent the reel shaft 50 from moving axially and unexpectedly separating from the wire-winding device 20.

Furthermore, in accordance with another aspect of the present invention, a ratchet mechanism is arranged between the reel shaft 50 and the first casing member 23. The ratchet mechanism comprises a toothed section 43 formed on the axle 41 of the crank arm 40 and at least one spring plate 33, preferably two as shown fixed in the first casing member 23 and having a free end engaging with the toothed section 43. The ratchet mechanism may prevent the wire 22 from unwound from the reel shaft 50 due to gravity when the crank arm 40 is released or not securely held by a user. In this way, the canopy of the umbrella incorporating the wire-winding device 20 may be selectively opened to any desired half-opened position and securely held in such condition by the ratchet mechanism.

The contact between the end of the spring plate 33 and the toothed section 43 of the crank arm 40 generates sound and vibration during the rotation of the reel shaft 50 which keeps the user aware of the rotation of the reel shaft 50.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A wire-winding device for reversibly actuating the reconfiguration of an umbrella between open and closed configurations comprising:

(a) a casing having an opening formed therethrough, said casing having formed therein a bore opposing said opening, said bore being defined by a base surface portion and a sidewall surface portion of predetermined length extending axially therefrom;

(b) a nut member disposed in axially displaceable manner within said bore of said casing;

(c) a crank arm coupled to said casing, said crank arm including an axle portion extending axially into said opening of said casing in angularly displaceable manner; and, (d) a reel shaft extending coaxially from said crank arm axle portion for angular displacement therewith, said reel shaft having an end portion threadedly engaging said nut member, said nut member being thereby axially displaceable toward said base surface portion of said casing bore responsive to angular displacement of said reel shaft in a predetermined angular direction, said nut member being limited in axial displacement by said casing bore base surface portion;

whereby an actuation wire of the umbrella may be selectively wound and unwound about said reel shaft to reconfigure the umbrella between the open and closed configurations thereof.

2. The wire-winding device as recited in claim 1 wherein said crank arm axle portion has formed therethrough a central bore, said central bore having a driving section defined by a polygonal sectional contour.

3. The wire-winding device as recited in claim 2 wherein said reel shaft coaxially engages said central bore of said crank arm axle portion, said reel shaft including a polygonal section corresponding in sectional contour to said central bore driving section for locking engagement therewith.

4. The wire-winding device as recited in claim 1 wherein said casing includes opposed first and second casing members, said first casing member defining at least a pair of inner threaded holes and having extending therefrom a plurality of resilient barbs, said second casing member defining a plurality of recesses respectively engaging said barbs of said first casing member in snap-fit manner.

5. The wire-winding device as recited in claim 1 further comprising at least one clip member having a substantially U-shaped portion extending between a pair of end portions, said clip member being releasably fastened to said first casing member for clamping a shank of the umbrella therebetween.

6. The wire-winding device as recited in claim 5 further comprising at least a pair of bolts each passing through one said end portion of said clip member and engaging one said inner threaded hole of said first casing member.

7. The wire-winding device as recited in claim 1 wherein said reel shaft has formed therein a hole for receiving an end of the actuation wire of the umbrella.

8. The wire-winding device as recited in claim 1 further comprising a C-clip coupled to said reel shaft for stopping the axial displacement thereof in at least one direction.

9. The wire-winding device as recited in claim 1 further comprising a ratchet mechanism operably disposed between said reel shaft and said casing.

10. The wire-winding device as recited in claim 9 wherein said ratchet mechanism includes:

(a) an annular toothed section angularly displaceable with said crank arm axle portion; and, (b) at least one spring plate coupled to project from said casing, said spring plate having a free end engaging said toothed section.

11. The wire-winding device as recited in claim 1 wherein said crank arm axle portion has formed thereon a plurality of teeth angularly spaced one from the other, and said casing includes at least one spring plate projecting therefrom, said spring plate having a free end sequentially engaging said teeth during angular displacement of said crank arm axle portion, whereby sound and vibration are generated.

12. The wire-winding device as recited in claim 1 wherein said sidewall surface portion of said casing bore is formed with a polygonal sectional contour corresponding to the sectional contour of said nut member.

* * * * *